US006182850B1

(12) United States Patent
Marbler et al.

(10) Patent No.: US 6,182,850 B1
(45) Date of Patent: Feb. 6, 2001

(54) CLOSURE MEMBRANES

(75) Inventors: Claude A. Marbler, Phalsbourg; Jean-Paul Boudinet, Walscheid, both of (FR)

(73) Assignee: Alusuisse Technology & Management Ltd., Neuhausen am Rheinfall (CH)

( * ) Notice: Under 35 U.S.C. 154(b), the term of this patent shall be extended for 0 days.

(21) Appl. No.: 09/328,426

(22) Filed: Jun. 9, 1999

(30) Foreign Application Priority Data

Jun. 24, 1998 (EP) ..... 98810578

(51) Int. Cl.[7] ..... B65D 77/22

(52) U.S. Cl. ..... 220/359.3; 220/364; 220/373; 383/103; 53/425; 428/137

(58) Field of Search ..... 220/363–365, 220/367.1, 373, 374, 359.1, 359.3, 359.4; 428/34.7, 35.2, 35.9, 344, 349, 354, 137, 138, 484; 206/484, 484.1, 484.2; 383/101, 103; 426/118, 521, 522; 53/404, 425, 478

(56) References Cited

U.S. PATENT DOCUMENTS

| | | | | |
|---|---|---|---|---|
| 3,716,180 | | 2/1973 | Bemiss et al. . | |
| 4,134,535 | | 1/1979 | Barthels et al. . | |
| 4,689,936 | * | 9/1987 | Gaikema et al. | 53/425 X |
| 5,071,667 | * | 12/1991 | Grune et al. | 53/425 X |
| 5,307,985 | * | 5/1994 | Beizermann | 220/364 X |
| 5,459,978 | * | 10/1995 | Weiss et al. | 53/425 |
| 5,531,341 | * | 7/1996 | Shlisky | 215/308 |
| 5,553,942 | | 9/1996 | Domke et al. . | |
| 5,665,408 | * | 9/1997 | Coupe et al. | 426/118 X |
| 5,968,459 | * | 10/1999 | Nalepa et al. | 215/308 X |

FOREIGN PATENT DOCUMENTS

| | | |
|---|---|---|
| 3521373 | 12/1986 | (DE) . |
| 0160978 | 11/1985 | (EP) . |
| 0672349 | 9/1995 | (EP) . |

* cited by examiner

*Primary Examiner*—Nathan J. Newhouse
(74) *Attorney, Agent, or Firm*—Fisher, Christen & Sabol

(57) ABSTRACT

Closure membrane for containers having an outer film and inner film with a joining layer and a sealing seam zone between these two films. At least one space free of a bonding layer is provided within the sealing seam zone between the outer film and the inner film and, within the limits of this non-bonded space, the outer film and the inner film each feature at least one opening, and a reservoir of material that softens under the influence of heat is provided in the non-bonded space between the outer film and the inner film. The openings in the inner film and the openings in the outer film are connected to enable the passage of a fluid such as a gas from the interior of the container to the surrounding atmosphere. On application of heat to the closure membrane e.g. during a sterilization process, the openings in the inner film and the outer film are closed off as a result of softening of the material that softens under the influence of heat.

14 Claims, 3 Drawing Sheets

CLOSURE MEMBRANES

BACKGROUND OF THE INVENTION

1. Field of the Invention

The present invention relates to a closure membrane for containers which comprises an outer film and inner film with a joining layer between these two films and a sealing seam zone.

2. Background Art

It is known to place substances, for example foodstuffs, in containers and to seal off beaker-type containers with a lid such as a closure membrane, or to seal off pouches by folding and sealing. Closure membranes may e.g. be made of papers, metal foils or plastic films, or laminates of several of the same or different metals, plastics and papers. The purpose of the closure membrane is to tightly seal the container in order to prevent ingredients of the contents escaping or preventing substances from outside entering the container. There are cases in which it is undesirable to have the container completely sealed by the closure membrane, this in order to allow the pressure in the interior of the container to adjust to that of the surrounding atmosphere. This concerns in particular cases in which the contents are placed in the container, the container is sealed, and the lidded container is subjected to a thermal treatment, such as, pasteurization, sterilization or ultrapasteurization. The intention is to prevent a positive pressure forming in the container that could cause the closure membrane to tear or rupture. This can be avoided by only partially sealing the closure membrane after filling the container, and allowing substances to escape at the non-sealed region between the edge of the container and the closure membrane. Subsequently, in another stage of the process, the closure membrane is then completely sealed onto the container.

In another version, described in EP-B 0 156 404, an opening for adjusting the pressure inside the container is provided on the container; after the thermal treatment, this opening is hermetically sealed by a polymer compound which melts on application of heat. This version, however, suffers the disadvantage that the polymer compound that can be melted is situated at an exposed area which is not protected from abrasion, and the opening for compensating for pressure differences provides a direct connection between the interior of the container and the surroundings.

BROAD DESCRIPTION OF THE INVENTION

The object of the present invention is to propose a closure membrane for a container or pouch which enables a container or pouch to be sealed in a sealing or other type of closing operation and enables the thermal treatment to be performed without substantial pressure on the lidded pouch or container, whereby the parts that create the valve effect are arranged such that they are protected from mechanical influence.

That objective is achieved by way of the invention in that within the sealing seam zone at least one space free of a bonding layer is provided within the sealing seam zone between the outer film and the inner film, and within this non-bonded space the outer film features at least one opening and the inner film features at least one opening, and a reservoir of material that softens under the influence of heat is provided in the non-bonded space between the outer film and the inner film, whereby the openings in the inner film and the openings in the outer film are connected for passage of a fluid, and the openings are closed by application of heat to the closure membrane as a result of softening of the material that softens on application of heat.

DETAILED DESCRIPTION OF THE INVENTION

The outer film may be a monofilm or a composite laminate film such that the outer film of a membrane film faces outwards. The inner film may be a monofilm or a composite laminate film such that the inner film of a membrane film faces towards the interior of the container.

Various materials may be employed for the outer and inner films. For example use may be made of monofilms or laminates containing thermoplastics e.g. polyolefins such as polyethylenes or polypropylenes, polyesters such as polyalkylene-terephthalates and in particular polyethylene-terephthalate, polyvinylchloride, polycarbonates or polyamides. Further materials in film form for the inner and outer films are cellophane, metal foils such as aluminium or steel foils or papers such as coated or impregnated papers. Use may also be made of foiltype laminates or composites made up of various materials such as metal foils and plastic films, plastic films and paper or paper, plastic films and metal foils. Suitable for the outer films and in particular for the inner films are thermoplastics and coextruded polyethylenes or cast polypropylene. These plastic films are sealable. The sealable plastic films may also form a laminate or composite along with other materials. For example, coextruded polyethylene or cast polypropylene may be arranged on a substrate film. Suitable substrate films may be in the form of monofilms or composite films from the above mentioned thermoplastics. It is also possible to achieve the sealing characteristic of the closure membrane by providing a sealable organic coating or sealable thermoplastic on the surface of the inner film. In order to achieve sealing properties with aluminium foils, paper or cellophane, a coextruded plastic film may e.g. laminate coated onto the material in question.

Preferred examples of outer films are films and laminated containing or comprising polyesters, polyolefins such as polypropylenes or polyethylenes, polyamides, cellophane, aluminium foils and papers. Further examples are sealable films or films of cast polypropylene or coextruded polyethylenes.

The outer films in particular may be provided with a printed image, a graphic design or embossing etc. A printed image may be deposited on the outside or it may be deposited as a counter image on transparent or translucent films or laminates—or it may be made by a combination of direct printing and counter printing.

Preferred sealing layers are films or films of cast polypropylene or coextruded polyethylenes laminate coated onto the inner film, or it may be foils or films of coextruded plastics on aluminium, paper or cellophane, or it may be an organic sealing coating.

The outer and/or the inner films may, as required, contain a barrier layer to prevent passage of gases and vapors such as moisture, active ingredients and aromas, air, oxygen etc. Barrier layers may be e.g. films of EVOH, films containing acrylnitril copolymers or thin i.e. 5 to 500 nanometre thick vacuum deposited ceramic layers e.g. containing silicon oxide and/or aluminium oxide (deposited by chemical or physical vapour deposition) etc.

A joining layer is provided between the outer and inner films. The joining layer is advantageously an adhesive based on water-based adhesives, solvent-containing adhesives, solvent-free adhesives or a single or two component adhesive or a laminating adhesive or a bonding agent.

The adhesives may be of or contain e.g. starches, albumin, casein adhesives, cellulose ethers and cellulose esters such as methylcellulose or nitrocellulose, natural caoutchouc, synthetic caoutchouc, polyethylene, ethylene-vinylacetate copolymers, polypropylene, polyvinylester, such as polyvinylacetate, polyvinylchloride-homopolymers or copolymers such as vinylchloride and vinylacetate or vinylchloride and methacrylic acid ester polymers, polyvinylether, polyvinyl-pyrrolidon, polystyrole, polyesters, polyurethanes, poly-isocyanates, epoxy resins, phenolic resins, resorcin resins such as resorcin-formaldehyde resins and resorcinphenolic-formaldehyde resins, urea formaldehyde resins, melamine-formaldehyde resins and non-reactive resins such as colophonic resins, liquid resins, carbohydrate resins, carbamic acid ester resin or cyclohexanon resins The adhesives may also container softeners. The adhesives may be solvent-free or may contain solvents such as e.g. benzine, toluol, xylol, methylene-chloride, trichlorethylene, trichlorethane, acetic ester, acetone-methylethyl-ketone, methyl-isobutyl-ketone or cyclohexanon. It is also possible to employ aqueous or water-free adhesives. The adhesives may also contain fillers such as silicas, chalks, light spar or barium sulphate or fibrous materials.

Various adhesive systems may be employed. For example adhesives that bond without chemical reaction or solvent-free adhesive systems in the form of melting adhesives or adhesive plastisoles. It is also possible to employ adhesive solutions whose solvents evaporate before bonding, contact adhesives or bond-type adhesives. It is also possible to employ adhesive solutions with solvents that evaporate during bonding, or aqueous starch and dextrin adhesives or other aqueous adhesive solutions. Mention must also be made of aqueous dispersions of polymeric compounds such as dispersion-type adhesives. Use may also be made of reaction-type adhesives such as polymerization adhesives among which are the two component polymerization adhesives and the single component polymerization adhesives. Mention should also be made of the poly-addition type adhesives such as reactive polyurethane adhesives and, finally, polycondensation-type adhesives such as polymethylol compounds, silicon adhesives or polyamides and poly-bezimide-azoles. Further adhesives are starch and dextrin adhesives, polyvinylacetate-dispersion adhesives, modified starch adhesives or casein stabilised copolymer dispersions or caoutchoucs or poly-acrylicester solutions or polyurethane adhesives. The adhesive layer may also be an extruded layer of polymers such as polyolefins, polyamides or polyesters.

Suitable bonding agents are e.g. vinylchloride copolymers, vinylchloride-vinylacetate copolymers, polymerisable polyesters, vinylpyridine polymers, vinylpyridine polymers com-bined with epoxy resins, butadien-acrylnitril-methacrylic acid copolymers, phenolic resins, caoutchouc derivatives, acrylic resins, acrylic resins with phenolic or epoxy resins, or silico-organic compounds such as organosilane. Preferred are the organisilanes. Examples thereof are tri-alkoxysilanes with amino-function groups, tri-alkoxysilanes with epoxy-function groups, tri-alkoxysilanes with aliphatic function-groups, tri-alkoxysilanes with glycide function-groups, tri-alkoxysilanes with methacryloxy function-groups and mixtures thereof. Examples of such organosilanes are amino-prophyl-triethoxysilane and N-b-(aminoithyl)-g-aminopropyl-trimethoxysilane, g-(3.4-epoxy-cyclohexy)-ethyl-trimethoxysilane, g-glycid-oxypropyl-trimethoxysilane and g-methacryl-oxypropyl-trimethoxysilane.

The preferred amount of adhesive for the joining layer is 1.4 to 12 g/m$^2$. The specially preferred amount of adhesive or bonding agent is from 4 to 7 g/m$^2$.

The material that softens under the influence of heat may be e.g. an organic coating such as a thermally softening lacquer. Examples thereof are hot-melts waxes and paraffins. The softening and melting point of the materials is depends on the intended heat treatment and may be e.g. in the range of 60° C. to 130° C. At these temperatures the thermally softening material should be in the plastic or viscous flow to molten state. For example, sterilization processes usually operate at a temperature of 121° C., which means softening or melting of the material must occur a few degrees e.g. 0.1 to 5° C. before or at this temperature.

The closure membrane exhibits at least one opening both in the outer film and in the inner film. This opening may have any desired cross-sectional shape i.e. round, oval, polygonal etc. The openings may also be in the form of cuts, points or perforations. The size of an opening in the outer film may be e.g. up to 0.2 mm, preferably from 0.02 to 0.2 mm and in particular 0.1 to 0.2 mm in diameter or diagonal length. The size of an opening in the inner film may be e.g. up to 0.5 mm, preferably from 0.05 to 0.5 mm and in particular 0.2 to 0.5 mm in diameter or diagonal length. Preferred are round openings with the mentioned diameters. There may also be two or more e.g. three, four, five, six, seven, eight, nine etc., openings in the outer film and/or inner film. In the case of a plurality of openings, their diameters may be smaller. Advantageous is for the total area of openings in the outer film to amount to 0.0013 mm$^2$ to 0.13 mm$^2$. Advantageous is for the total area of openings in the inner film to amount to 0.008 mm$^2$ to 0.8 mm$^2$.

In particular, the openings in the outer film and the inner film do not lie over each other—with respect to the closure membrane according to the invention as viewed in plan view—but are horizontally displaced with respect to each other, The closure membrane according to the invention may be manufactured as an endless strip or roll. The endless strip or roll may be processed into pouches. Thereby, a length of film for manufacturing a pouch usefully features at least one space free of a joining layer in which the material that softens under the influence of heat is situated and, the sealing seam zone may be formed by the sealing seams of the pouch or by sealing seams on the pouch. For lidding purposes, the endless strip or roll may also be sealed—in a continuous manner in a production process—e.g. onto beaker-type or dish-shaped containers and the containers separated along lines of separation. The present closure membrane may also be manufactured as end-less strip or in rolls and the closure membranes separated e.g. by means of stamping or like process. The individual closure membranes may be sealed onto the containers. It is also possible to manufacture the closure membranes individually and to seal them individually onto the containers.

The preferred endless strip or roll form product may be manufactured by creating the openings in the outer film and in the inner film, e.g. by rolling or stamping, or by employing tools bearing needles, using cutting or perforating tools, punches, energy beams such as laser beams or electron beams, thermal or high frequency heating, or by chemical means such as selective dissolution using a solvent, or by means of an etching process. The outer and inner films are laminated to each other via the joining layer, whereby in the region of the openings a space is provided free of materials such as adhesives of the joining layer. The material that softens under the influence of heat is introduced into this space free of joining layer. The sequence of deposition of the joining layer and the material that softens under the influence of heat may be interchanged. The joining layer may e.g. be deposited by spreading, spraying, rolling, wiping or printing the adhesive or bonding agent by means of a printing process such as relief printing, flexo-printing, lithographic printing, offset printing, intaglio printing, penetration printing, screen printing, etc. The deposition of the material that softens under the influence of heat may, as described, likewise preferably take place by one of the above mentioned processes. It is advantageous for the printing step to take place such that the advancement of the material to be printed on is controlled e.g. by a photocell or the like, which ensures that the position of the printed images with respect to each other is always the same.

For example, the outer film may be printed in a printing machine and/or counterprinted and any desired image such as advertising, information about the product, pictures, script, patterns, graphic designs etc. deposited in this manner. For example, the openings are made in the outer film in the form of pin holes using a perforating needle-type roll or tool, which may be mounted in the printing machine. Subsequently, the joining layer and the material that softens on heating are deposited in the printing machine as a printed image on the outer film. The inner film, possible later exhibiting a sealing layer on the side facing the container, is also provided with openings. These may likewise also be created using a needle-type roll or tool. The outer film and the inner film are subsequently laminated together. All production steps may be performed simultaneously in one device. The process is in particular performed in a continuous manner and the result is a composite film in the form of an endless strip or roll.

In order to lid the containers, the filled containers are covered by the composite film in a continuous manner and the composite film sealed onto the containers at their edges. This ensures that each lid exhibits openings within the sealing seam in their outer and inner films and a space with material that softens under the influence of heat. In the case of pouches the closure membrane may form a part of a wall or at least one or all of the walls of the pouch.

The types of containers that may be employed here are e.g. beakers, bottles, pots, dishes etc., with openings for filling or removing the contents and of any size of choice. The closure membranes according to the invention may be employed e.g. for closing and lidding containers such as beakers, bottles, pots, goblets, dishes made of plastic, glass, ceramic, metal etc., glasses, or for forming or closing off pouches, soft film bags, free-standing pouches etc., made of plastic films, and metal foils and/or paper. The containers may be filled with liquid to solid foodstuffs, semi-luxury materials or foods etc., such as drinks, milk products, ready-made foods, animal fodder etc.

It is also possible e.g. to fill the containers with fermenting substances and to close them off with the closure membrane according to the invention. The gases formed during fermentation may escape from the container—according to the internal pressure controlled by the formation of the openings in the closure membrane. By applying a heat treatment the fermentation process can be stopped and the closure membrane closed. Thereafter it is not possible for germs such yeast cultures to enter the container.

BRIEF DESCRIPTION OF THE DRAWINGS

The present invention is explained in greater detail by way of example with the aid of the following drawings in FIGS. 1 to 6.

DETAILED DESCRIPTION OF THE INVENTION

Figure 1:
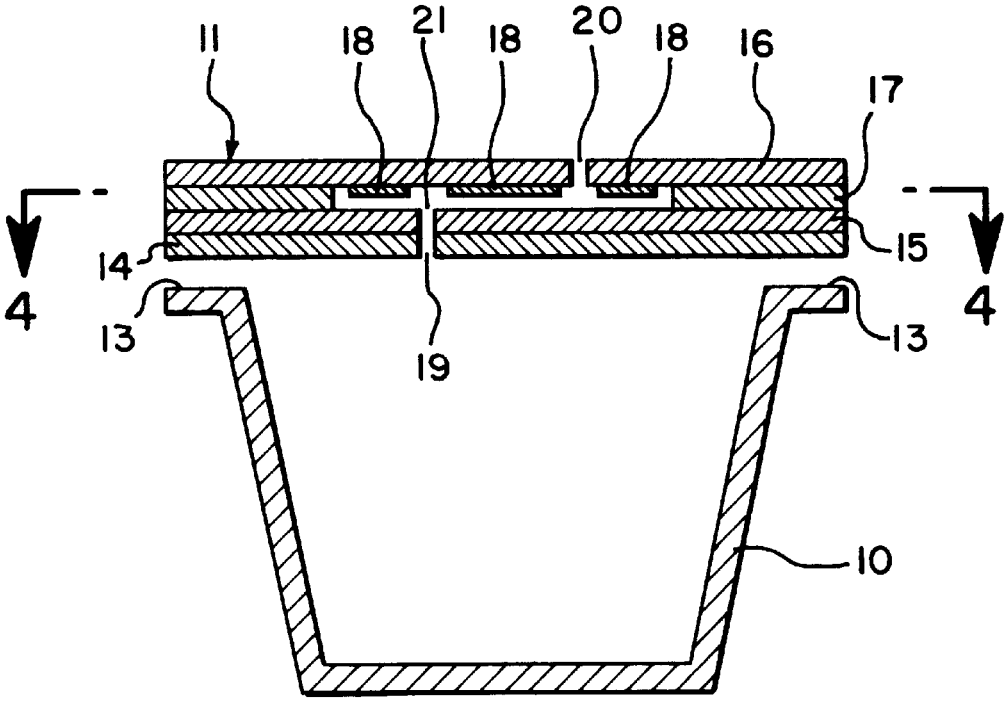
FIG. 1 shows a cross-section through a container according to the invention during the lidding process.

Shown in FIG. 1 is the container 10 with the intended sealing area 13—the shoulder of the container 10—and the closure membrane 11. The closure membrane 11 exhibits a sealing layer 14 facing the container. The closure membrane 11 features the inner film 15 and outer film 16. Both films 15 and 16 are joined to each other in a permanent manner by means of the joining layer 17 e.g. a layer of adhesive. The joining layer 17 completely surrounds a central region, the adhesive-free space 21. Lying or printed on the outer layer 16 is the material 18 that softens under the influence of heat. In the direction of the inner film 15 the material 18 that softens under the influence of heat exhibits a gap or does not bond to the inner film 15. An opening 19 is provided in the inner film 15. An opening 20 is provided in the outer film 16. The openings 19 and 20 are usefully displaced with respect to each other. FIG. 1 shows a section through the closure membrane along the line A—A in FIG. 4.

Figure 2:
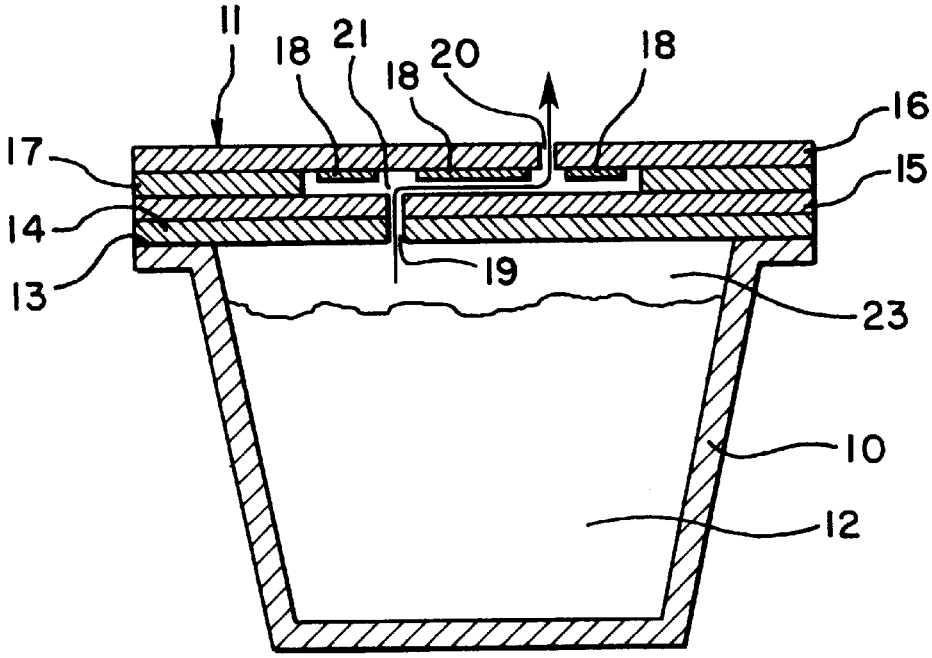
FIG. 2 shows a cross-section through a container according to the invention during heat treatment.

FIG. 2 shows the lidded container 10, 11 filled with the contents 12. The contents may e.g. be a foodstuff or fodder preparation. The closure membrane 11 is tightly sealed to the container 10 in the sealing area 13 via sealing seam 14. The lidded container 10, 11 is then subjected, e.g., to a heat treatment such as pasteurization, sterilization or ultrapasteurization. The gas which gathers above the fluid under the influence of heat 23 and any gaseous constituents and vapor released by the contents 12 are able to pass through the opening 19 in the direct-ion indicated by the arrow and can flow through or past the material 18 that softens under the influence of heat and exit through the opening 20 in the outer film into the surrounding atmosphere. There is no loss of pressure in the lidded container 10, 11.

Figure 3:
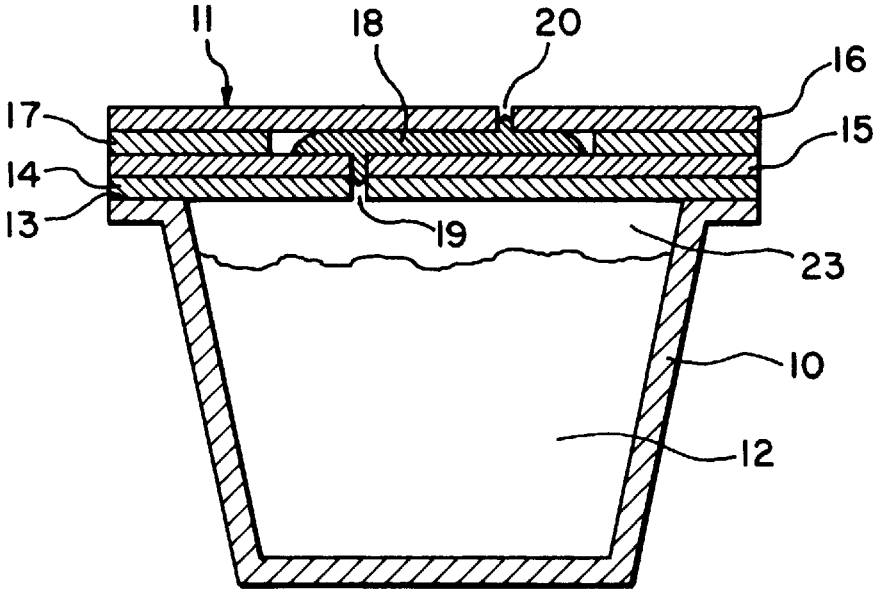
FIG. 3 shows a cross-section through a container according to the invention during cooling.

FIG. 3 shows the situation on subsequently cooling the container. The tendency is for the surrounding air to be sucked into the lidded container 10, 11 and in particular into the space where the gas 23 is situated. The material 18 that softens under the influence of heat, which is in a liquid to pasty state as a result of heating, enters the opening 19 in the inner film and at the same time hardens as a result of the cooling. As a result the material 18 that softens under the influence of heat closes off the opening 19 in a reliable manner. Further, the material 18, that softens under the influence of heat hardens on cooling, closes off the opening 20 in the outer film and can stick the inner and outer films 15, 16 to each other. The closure membranes according to the invention performs therefore the function of a valve that permits gaseous constituents to escape from the container during a thermal treatment and on cooling prevents the flow e.g. of gases in the opposite direction. As a result germs, for example, are no longer able to enter the container.

Figure 4:
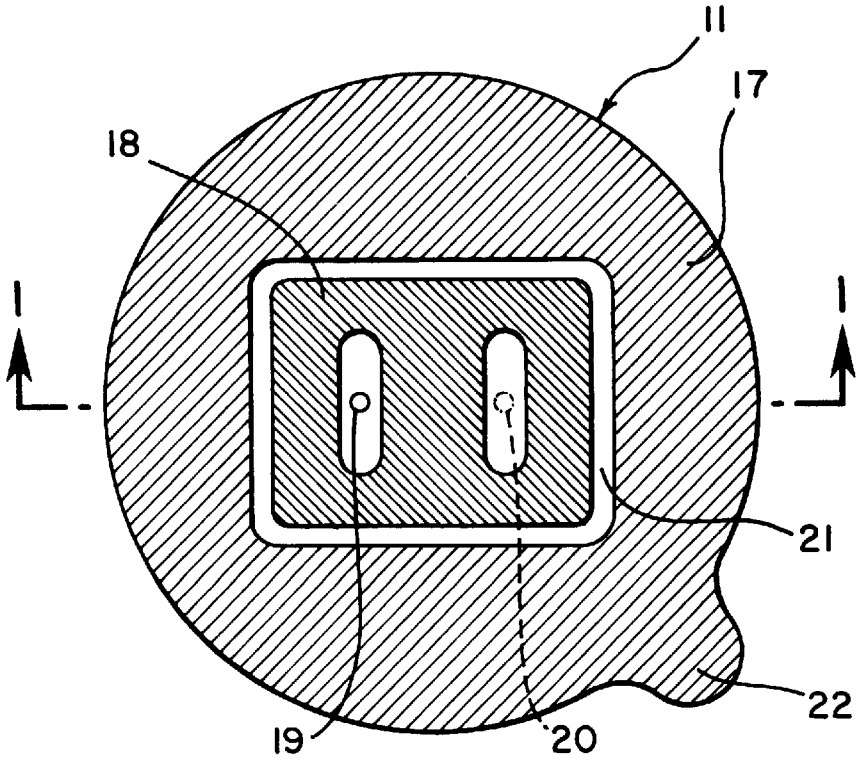
FIG. 4 shows a plan view of a container according to the invention along section line B—B in FIG. 1.

FIG. 4 shows a cross-sectional plan view of a closure membrane 11 along a line B—B in FIG. 1. The closure membrane exhibits approximately the same contour as that of the underlying container and is provided a gripping flap 22 for later, enabling easy removal of the closure membrane 11 from the container 10. The plan view shows the joining layer 17 e.g. an adhesive that permanently joins the outer and inner films together without danger of delamination. The joining layer 17 surrounds a space 21 that is free of adhesive and is filled with the material 18 that softens under the influence of heat such as an organic coating, hotmelt, paraffin, wax etc. The opening 19 in the inner film and the opening 20 in the outer film preferably do not lie over each other, but displaced with respect to each other on a horizontal plane. In the present example the openings 19, 20 are not covered by the material 18 that softens under the influence of heat, but are only surrounded by that material 18. FIGS. 1, 2 and 3 show the container 10 and the closure membrane 11 along the section line A—A.

Figure 5:
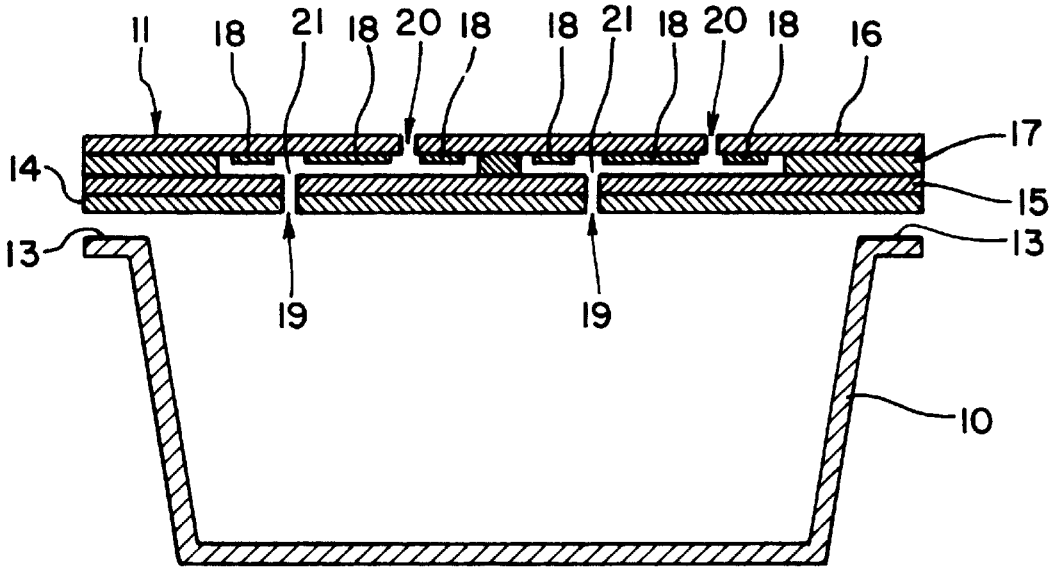
FIG. 5 shows an invention embodiment of a container with a closure membrane.
Figure 6:
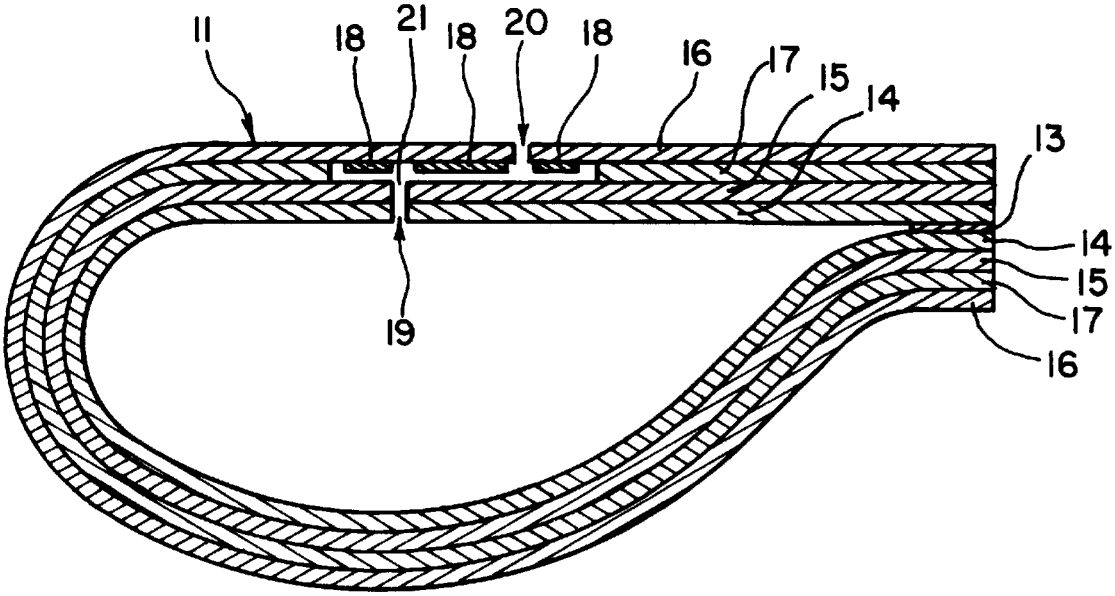
FIG. 6 shows a cross-sectional view of an invention embodiment of a pouch.

FIG. 5 shows a container with a closure membrane, having two openings in the inner film and two openings in the outer film. FIG. 6 shows a cross-section of a pouch, made from a composite film having essentially the structure of the closure membrane and having the valve part. The composite film is folded once and sealed at its outer periphery at position 13. Accordingly, sealing seams would be arranged at the upper and lower ends of the pouch and are not visible in the cross-section.

What is claimed is:

1. Closure membrane (11) for containers (10), comprising an outer film (16) and an inner film (15) and a joining layer (17) between both films (15, 16) and a sealing seam zone (13), at least one nonbonded space (21) free of a bonding layer is provided within the sealing seam zone (13) between the outer film (16) and the inner film (15), and within this non-bonded space (21) the outer film (16) features at least one opening (20), and the inner film (15) features at least one opening (19), and a reservoir of material (18) that softens under the influence of heat is provided in the non-bonded space (21) between the outer film (16) and the inner film (15), whereby the at least one opening (19) in the inner film (15) and the at least one opening (20) in the outer film (16) are connected to permit through-flow of a fluid (23), and the at least one opening (19) and the at least one opening (20) are closed by application of heat to the closure membrane (11) as a result of softening of the material (18) that softens on application of heat.

2. Closure membrane (11) according to claim 1, wherein the diameter or diagonal length of the at least one opening (20) in the outer film (16) is up to 0.2 mm in size.

3. Closure membrane (11) according to claim 1, wherein the diameter or diagonal length of the at least one opening (19) in the inner film (15) is up to 0.5 mm in size.

4. Closure membrane (11) according to claim 1, wherein the at least one opening (19) and at least one opening (20) are round, oval or polygonal.

5. Closure membrane (11) according to claim 1, wherein two or more openings (19, 20) are provided in the outer film (16) and/or inner film (15).

6. Closure membrane (11) according to claim 1, wherein the total area of the at least one opening (20) in the outer film (16) is from 0.0013 $mm^2$ to 0.13 $mm^2$.

7. Closure membrane (11) according to claim 1, wherein the total area of the at least one opening (19) in the inner film (15) is from 0.008 $mm^2$ to 0.8 $mm^2$.

8. Closure membrane (11) according to claim 1, wherein the at least one opening (20) in the outer film (16) and the at least one opening (19) in the inner film (15) are displaced with respect to each other.

9. Closure membrane (11) according to claim 1 wherein the diameter or diagonal length of the at least one opening (20) in the outer film (16) is from 0.02 to 0.2 mm.

10. Closure membrane (11) according to claim 1, wherein the diameter or diagonal length of the at least one opening (20) in the outer film (16) is from 0.1 to 0.2 mm.

11. Closure membrane (11) according to claim 1, wherein the diameter or diagonal length of the at least one opening (19) in the inner film (15) is from 0.2 to 0.5 mm.

12. Closure membrane according to claim 1, wherein the diameter or diagonal length of the at least one opening (19) in the inner film (15) is from 0.2 to 0.5 mm.

13. Process for manufacturing the closure membrane according to claim 1, comprising treating the outer film (16) in a printing machine, usefully printing and/or counter printing a pattern on the outer film (16) and subsequently presenting the inner film (15) to the treated outer film (16) and bonding the outer film (16) and the inner (15) together by means of the joining layer (17), in the printing machine, the at least one onening (20) in the form of pinhole is made in the outer film (16) using a needle-type roll or die, and the material (18) that softens under the influence of heat is deposited in the printing machine as a printed pattern, and the at least one opening (19) is made in the inner film (15) using a needle-type roll or die, and subsequently laminate bonding or adhesively bonding the outer film (16) and the inner film (15) together.

14. Process of using the closure membrane (11) according to claim 1 comprising lidding containers in the form of beakers, bottles, goblets or dishes made from plastic, glass, ceramic, metal, or glasses by means of the closure membrane (11), or forming or closing off pouches, soft film pouches or self-standing pouches by means of the closure membrane (11).

* * * * *